US009890529B2

(12) United States Patent
Kim

(10) Patent No.: US 9,890,529 B2
(45) Date of Patent: Feb. 13, 2018

(54) SANITARY TOILET

(71) Applicant: Sang-Gu Kim, Jeollabuk-do (KR)

(72) Inventor: Sang-Gu Kim, Jeollabuk-do (KR)

( * ) Notice: Subject to any disclaimer, the term of this patent is extended or adjusted under 35 U.S.C. 154(b) by 280 days.

(21) Appl. No.: 14/764,867

(22) PCT Filed: Dec. 18, 2013

(86) PCT No.: PCT/KR2013/011809

§ 371 (c)(1),
(2) Date: Jul. 30, 2015

(87) PCT Pub. No.: WO2014/129734

PCT Pub. Date: Aug. 28, 2014

(65) Prior Publication Data

US 2015/0354189 A1 Dec. 10, 2015

(30) Foreign Application Priority Data

Feb. 19, 2013 (KR) ..... 10-2013-0017247
Feb. 22, 2013 (KR) ..... 10-2013-0019071
(Continued)

(51) Int. Cl.
*E03D 9/05* (2006.01)
*E03D 9/04* (2006.01)
(Continued)

(52) U.S. Cl.
CPC ..... *E03D 9/052* (2013.01); *A47K 13/307* (2013.01); *E03D 9/05* (2013.01)

(58) Field of Classification Search
CPC ..... E03D 9/052; A47K 13/307
(Continued)

(56) References Cited

U.S. PATENT DOCUMENTS 4,165,544 A * 8/1979 Barry ..... E03D 9/052 4/213
4,318,192 A * 3/1982 Williams ..... E03D 9/052 4/213
2007/0113327 A1* 5/2007 Denkewicz, Jr. ..... A61L 9/015 4/213

FOREIGN PATENT DOCUMENTS

JP 06-072494 10/1994
JP 3129164 1/2007
(Continued)

OTHER PUBLICATIONS

International Search Report dated Mar. 31, 2014 for PCT/KR2013/011809.

*Primary Examiner* — Christine Skubinna

(57) ABSTRACT

Disclosed is an improved sanitary toilet bowl capable of protecting a human body against bacteria and giving a comfortable environment to a toilet by sucking and removing bad smell and bacteria. The sanitary toilet bowl includes a valve unit mounted to open or close a top of the overflow tube according to a water level in the water tank, an air suction tube installed to communicate with the overflow tube through the valve unit, a circulating pump installed in water of the water tank and having a circulating water suction tube and a circulating water discharge tube respectively provided at both ends thereof to suck the water stored in the water tank and discharge the sucked water for circulation, and a Venturi tube installed on the circulating water suction tube or the circulating water discharge tube and connected to the air suction tube perpendicularly to generate an Venturi effect.

8 Claims, 9 Drawing Sheets

(30) Foreign Application Priority Data

May 13, 2013 (KR) ..... 10-2013-0053584
Jul. 29, 2013 (KR) ..... 10-2013-0089842
Nov. 2, 2013 (KR) ..... 10-2013-0132599

(51) Int. Cl.
*E03D 9/052* (2006.01)
*A47K 13/30* (2006.01)

(58) Field of Classification Search
USPC ..... 4/347–351, 213–219
See application file for complete search history.

(56) References Cited

FOREIGN PATENT DOCUMENTS

| | | |
|---|---|---|
| KR | 10-2003-0039141 | 5/2003 |
| KR | 10-0568252 | 4/2006 |
| KR | 10-2011-0123449 | 11/2011 |
| KR | 10-2013-0002392 | 1/2013 |

* cited by examiner (a)

(b)

(a)

(b)

(a)

(b)

SANITARY TOILET

This application claims the priority of Korean Patent Application Nos. KR 10-2013-001724, filed on Feb. 19, 2013, KR 10-2013-0019071, filed on Feb. 22, 2013, KR 10-2013-0053584, filed on May 13, 2013, KR 10-2013-0089842, filed on Jul. 29, 2013, and KR 10-2013-0132599, filed on Nov. 2, 2013 in the KIPO (Korean Intellectual Property Office), the disclosure of which is incorporated herein entirely by reference. Further, this application is the National Stage application of International Application No. PCT/KR2013/011809, filed Dec. 18, 2013, which designates the United States and was published in Korean. Each of these applications is hereby incorporated by reference in their entirety into the present application.

TECHNICAL FIELD

This disclosure relates to a sanitary toilet bowl, and more particularly, to an improved sanitary toilet bowl capable of protecting a human body against bacteria and giving a comfortable environment to a toilet by sucking and removing bad smell and bacteria generated during defecation.

BACKGROUND ART

Generally, a toilet bowl (which is a western toilet bowl) means a western flush toilet bowl on which a human sits and relieves himself.

The toilet bowl generally includes a pedestal on which a human sits to relieve himself, a toilet bowl body for discharging excretion to a septic tank together with a service water, and a water tank provided at a top of one end of the toilet bowl body to supply, store and drain a service water so that excretion is discharged to the septic tank.

The toilet bowl is configured to temporarily store and discharge urine and feces discharging from an eliminatory organ of a human who relieves himself, and thus gives seriously bad smell during defecation. Also, it is known that various kinds of pathogenic bacteria, for example salmonellas, colon bacillus, Shigell, clostridium botulinum or the like, tend to breed well, and particularly, it has been reported that *staphylococcus aureus, pseudomonas aeruginosa*, monococcus, streptococcus or the like breed at a portion which contacts the human body.

However, the pathogenic bacteria may harm a user depending on his physical condition, and the pathogenic bacteria may cause various skin ailments or respiratory ailments and may also give serious displeasure in use.

In this regard, many techniques have been disclosed in Korean Unexamined Patent Publication No. 2004-0103432, Korean Unexamined Patent Publication No. 2010-0049464, Korean Unexamined Patent Publication No. 2010-0106892, Korean Patent Registration No. 0568252, Korean Utility Model Registration No. 0393220 or the like.

However the techniques disclosed above mostly adopts chemicals, ultraviolet treatment or ultrasonic washing as a deodorizing, sterilizing, pasteurizing or antibacterial means for removing bad smell or pathogenic bacteria, which requires a complicated structure but does not give a great effect in comparison to costs.

For this reason, most users prevents pathogenic bacteria from propagating to the entire toilet by manipulating a lever to discharge excretion after closing a toilet bowl cover after defecation. In fact, it has been reported in various papers and mass media that when the toilet bowl cover is closed, the propagation of pathogenic bacteria is reduced in half in comparison to the caser when the toilet bowl cover is not closed.

However, since it is inconvenient to close a toilet bowl cover each time, users frequently do not close the toilet bowl cover due to cumbersomeness and troublesomeness. Also, even though it is required to pay an attention to close the toilet bowl cover, users may easily forget this, and thus it is practically not easy to close the toilet bowl cover.

Meanwhile, as a technique for removing gas generated during defecation, Korean Utility Model Registration No. 0451717 discloses that a suction hole and a suction line are formed in a toilet bowl sheet, namely in a toilet bowl pedestal, and a circulation tube for sucking and discharging water into/from a water tank is formed, so that when the circulating water circulates through the circulation tube, the gas generated during defecation is absorbed by means of a kind of Venturi effect and thus bad smell is removed.

However, in this technique, since a water circulating instrument is installed at an outer portion of the water tank, there are some disadvantageous such as complicated structure and bad appearance. In addition, since a circulation hose should be installed through the water tank, it is not easy to give a watertight structure. For this reason, in spite of excellent technical features, the above technique may not be easily commercialized and may be easily neglected by consumers, which results in bad utilization.

In particular, since sucking channels for removing smell are formed in the toilet bowl sheet, there is a structural limit in that the circulating instrument is inevitably provided out of the water tank.

Moreover, an aspirator provided to give Venturi effect must have a check valve in order to prevent the circulating water from flowing backward.

In addition, at the toilet bowl sheet, namely at the toilet bowl pedestal, as shown in FIG. 1(*a*), a protrusion 12 is formed to protrude thereon in order to keep a gap when a lower surface of the toilet bowl pedestal 10 is closed in a parallel state. Also, if there is a groove 14 in state where the lower surface of the toilet bowl pedestal 10 is opened as shown in FIG. 1(*b*), the protrusion 12 is provided to protrude slightly further to the rim of the toilet bowl pedestal 10 inside the groove 14. For this reason, the existing toilet bowl pedestal 10 inevitably has a gap between the upper surface of the toilet bowl body and the toilet bowl pedestal 10.

Therefore, even though the toilet is flushed to discharge defecation after the toilet bowl cover is closed, bad smell or pathogenic bacteria in the toilet bowl leak through the gap, and thus it is substantially not meaningful to close the toilet bowl cover.

DISCLOSURE OF THE INVENTION

Technical Problem

This disclosure is directed to providing a toilet bowl pedestal for a sanitary toilet bowl, which may have a simple structure to ensure easy installation and use and low manufacture costs, effectively remove bad smell and pathogenic bacteria to protect a human body, and give a pleasant environment to a toilet.

Moreover, the present disclosure is also directed to providing a toilet bowl pedestal, which may greatly contribute to environmental improvement of a toilet by ensuring great sealing, when being installed to a general toilet bowl as well as a sanitary toilet bowl, in spite of its simple structure.

Technical Solution

In one general aspect of the present disclosure, there is provided a sanitary toilet bowl, which includes a toilet bowl body 100, a water tank T for supplying water to the toilet bowl body 100, a main supply tube 300 for connecting the water tank T to the toilet bowl body 100, and an overflow tube 200 connected to one side of the main supply tube 300 and installed in the water tank T to allow water over a predetermined level to overflow to the main supply tube 300, the sanitary toilet bowl comprising: a valve unit 400 mounted to open or close a top of the overflow tube 200 according to a water level in the water tank T; an air suction tube 500 installed to communicate with the overflow tube 200 through the valve unit 400; a circulating pump 700 installed in water of the water tank T and having a circulating water suction tube 710 and a circulating water discharge tube 720 respectively provided at both ends thereof to suck the water stored in the water tank T and discharge the sucked water for circulation; and a Venturi tube 600 installed on the circulating water suction tube 710 or the circulating water discharge tube 720 and connected to the air suction tube 500 perpendicularly to generate an Venturi effect.

In addition, in another aspect of the present disclosure, there is provided a sanitary toilet bowl, which includes a toilet bowl body 100, a water tank T for supplying water to the toilet bowl body 100 to discharge excretion to a septic tank after defecation, and a supply water feeding chamber 130 formed along an upper circumference of the toilet bowl body 100 so that the water supplied from the water tank T partially flows down along an inner wall of the toilet bowl body 100, the sanitary toilet bowl comprising: an air suction chamber 132 formed in an upper space formed by dividing the supply water feeding chamber 130 into upper and lower spaces by a partition W; a plurality of air suction holes 134 formed along an inner circumference of the air suction chamber 132; an air blower 136 configured to suck an inner air of the air suction chamber 132 and discharges the air; and a flexible tube 138 configured to connect the air suction chamber 132 to the air blower 136.

Moreover, in another aspect of the present disclosure, there is provided a sanitary toilet bowl, which includes a toilet bowl body 100, a water tank T for supplying water to the toilet bowl body 100 to discharge excretion to a septic tank after defecation, and a pedestal body 800 provided between the toilet bowl body 100 and a toilet bowl cover to relieve a seating feeling, the sanitary toilet bowl comprising: an air suction chamber 132 formed along a lower circumference of the pedestal body 800; a plurality of air suction holes 134 formed along a circumference of the air suction chamber 132; an air blower 136 configured to suck an inner air of the air suction chamber 132 and discharges the air; and a flexible tube 138 configured to connect the air suction chamber 132 to the air blower 136.

Further, in another aspect of the present disclosure, there is provided a sanitary toilet bowl, which includes a toilet bowl body 100, a water tank T for supplying water to the toilet bowl body 100, a main supply tube 300 for connecting the water tank T to the toilet bowl body 100, and an overflow tube 200 connected to one side of the main supply tube 300 and installed in the water tank T to allow water over a predetermined level to overflow to the main supply tube 300, the sanitary toilet bowl comprising: a valve unit 400 mounted to open or close a top of the overflow tube 200 according to a water level in the water tank T; an air exhaust pipe 900 configured to communicate with the overflow tube 200 through the valve unit 400; and an air blower 136 connected to the air exhaust pipe 900 to discharge an air in the toilet bowl body 100 outwards.

In addition, in another aspect of the present disclosure, there is provided a sanitary toilet bowl, which includes a toilet bowl body 100, a pedestal body 800 installed at an opening of the toilet bowl body 100, and a water tank T for supplying water to the toilet bowl body 100, the sanitary toilet bowl comprising: an air suction chamber 132 formed in the pedestal body 800 and having a plurality of suction holes; an air blower 136 connected to the air suction chamber 132 and installed at a rear end of the pedestal body 800; at least one ultraviolet lamp UVL installed at a lower surface of the pedestal body 800 to irradiate ultraviolet rays for a predetermined time after the air blower 136 stops operation; an air exhaust pipe 900 extending from a discharge end of the air blower 136 and connected into the water tank T; and a bubble generator AIR fixed to an end of the air exhaust pipe 900 and disposed to be soaked in the water tank T.

Advantageous Effects

According to the present disclosure, it is possible to prevent bacteria and bad smell from propagating, provide more pleasant toilet environment by preventing pathogenic bacteria from spreading to the entire toilet after defecation, and allow easy installation with a simple structure to ensure low manufacture costs, which leads to fabrication of popular toilet bowls.

Figure 1:
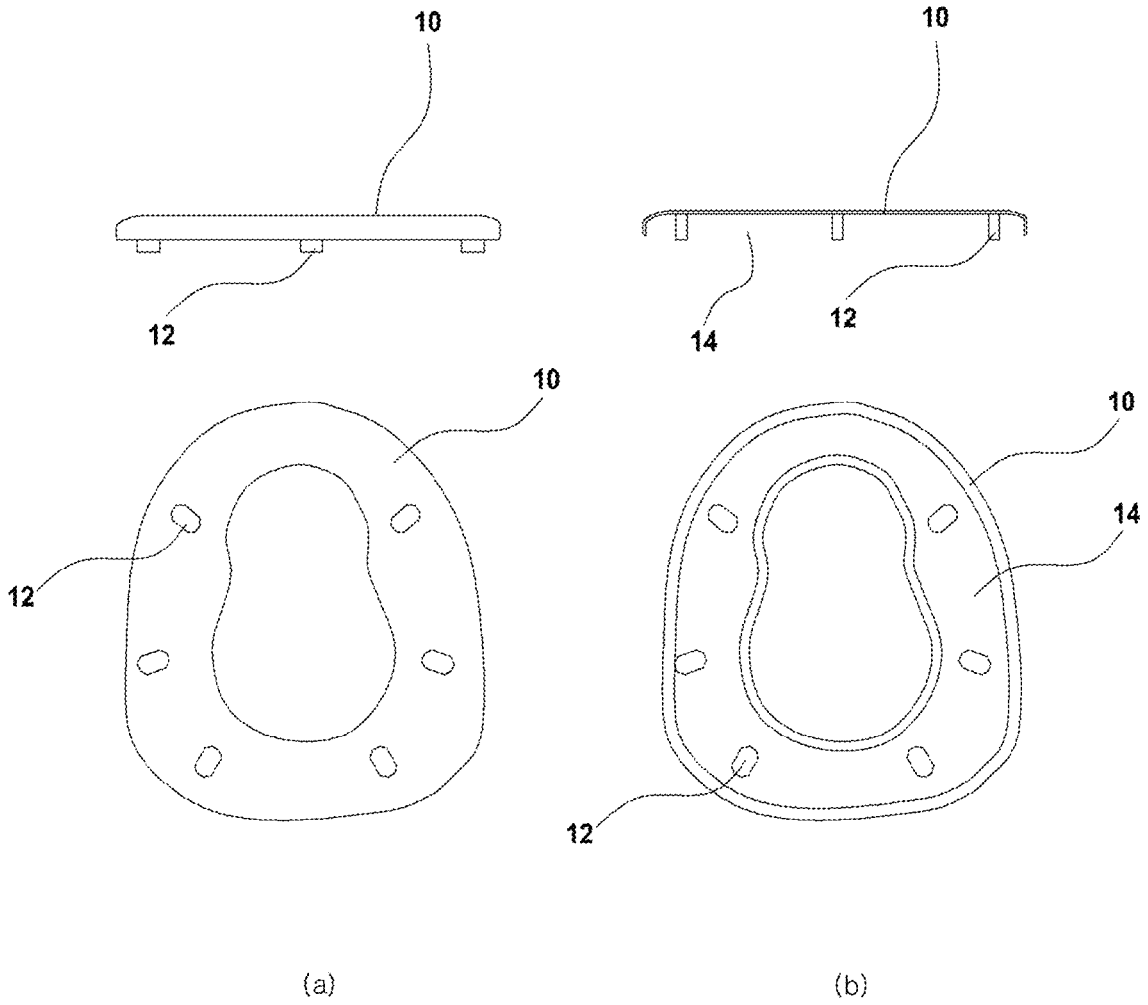
FIG. 1 is a diagram showing an existing toilet bowl pedestal.

| [Detailed Description of Main Elements] | |
|---|---|
| 100: toilet bowl body | 200: overflow tube |
| 300: main supply tube | 400: valve unit |
| 500: air suction tube | 600: Venturi connector |
| 700: circulating pump | 800: pedestal body |

MODE FOR CARRYING OUT THE INVENTION

Hereinafter, preferred embodiments of the present disclosure will be described in detail with reference to the accompanying drawings.

Prior to the description, it should be understood that the description proposed herein about specific structures or functions is just a preferable example for the purpose of illustrations only, not intended to limit the scope of the disclosure, so it should be understood that the embodiments could be made implemented in various ways without departing from the scope of the disclosure.

In addition, various equivalents and modifications can be made to the embodiments of the present disclosure, and thus specific embodiments will be illustrated in the drawings and described in detail in this specification. However, this is not intended to specially limit the embodiments of the present disclosure, but it should be understood that all changes, modifications and equivalents belonging to the range of the present disclosure fall within the scope of the present disclosure.

First Embodiment

Figure 2:
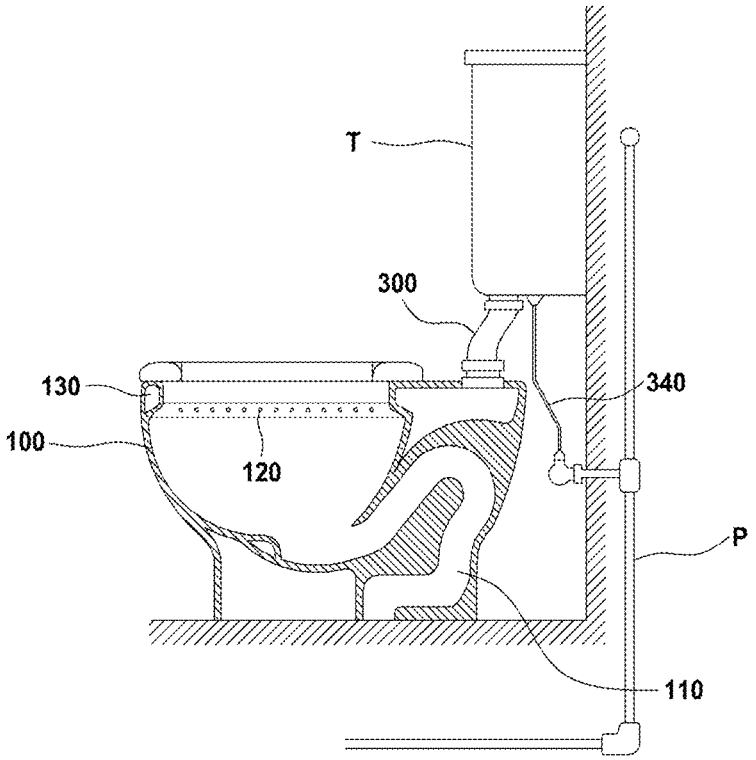
FIG. 2 is a cross-sectional view showing a sanitary toilet bowl according to the first embodiment of the present disclosure.
Figure 2:
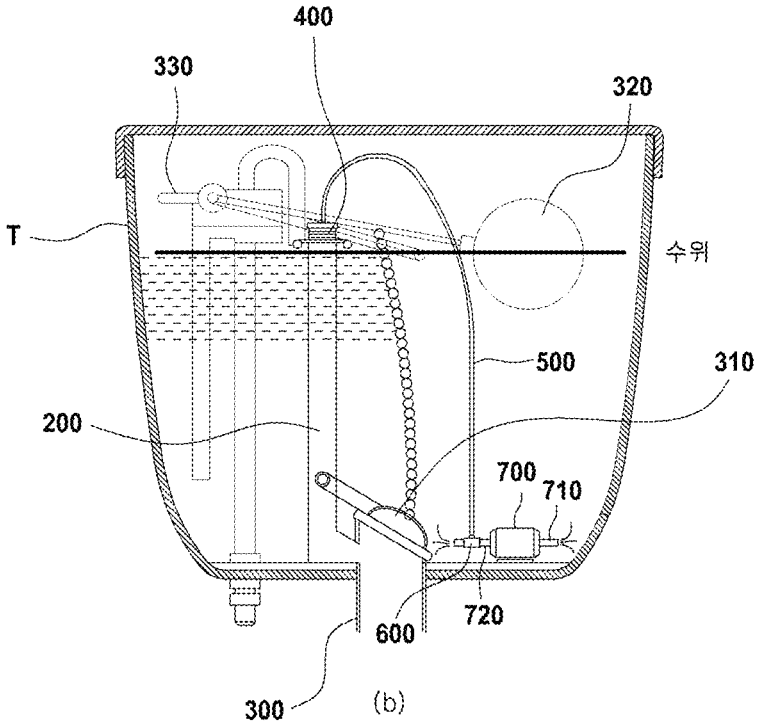
Figure 3:
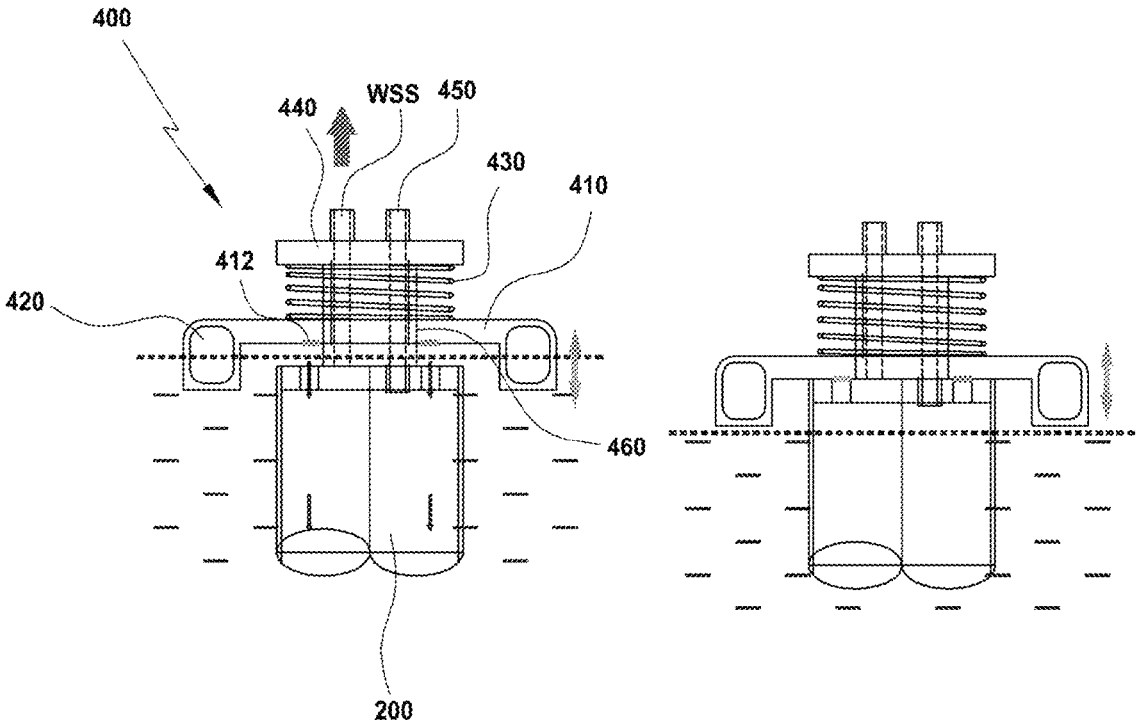
FIG. 3 is a cross-sectional enlarged view showing a valve unit of the sanitary toilet bowl according to the first embodiment of the present disclosure.
Figure 3:
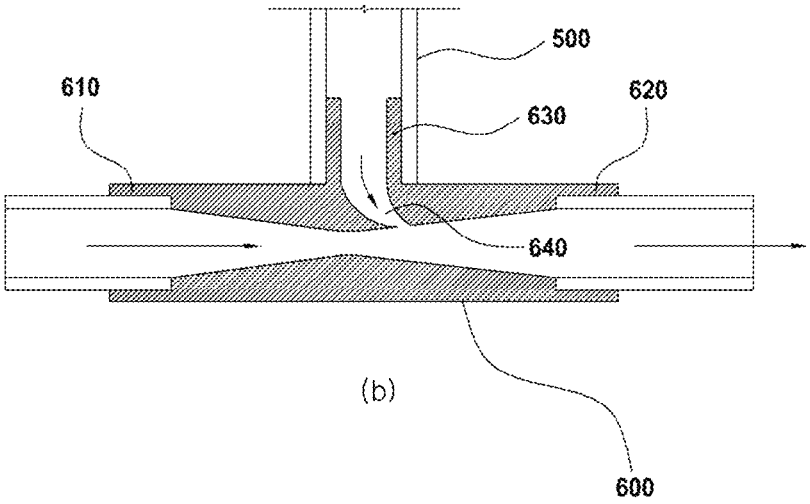

As shown in FIGS. 2 and 3, a sanitary toilet bowl according to the first embodiment of the present disclosure includes a toilet bowl body 100.

The toilet bowl body 100 has a structure well known in the art and is configured to store a certain amount of water therein and discharge excretion generated by a user to a sewage tank through a drainage hole 110 by using the stored water.

At this time, the water utilized for discharging the excretion to the sewage tank, namely a septic tank, is a service water stored in a water tank T provided at a top of one side of the toilet bowl body 100, similar to an existing technique, and its connection structure is also identical to an existing one.

In particular, since impurities and urine splashing during defecation are stuck to an inner wall of the toilet bowl body 100, a plurality of injection holes 120 are formed in an inner circumference of the top of the toilet bowl body 100 and arranged in a circumferential direction to wash out the impurities and urine. Also, the injection hole 120 is connected to a supply water feeding chamber 130, and the supply water feeding chamber 130 is connected to the water tank T to supply water together when service water is supplied.

The present disclosure uses such a basic structure of an existing toilet bowl body 100 and is configured to effectively remove bad smell and pathogenic bacteria generated during defecation by sucking bad smell and pathogenic bacteria generated in the toilet bowl body 100 through an overflow tube 200, dissolving and removing them in the water tank T, and then discharging them to a septic tank through a drainage hole 110 when excretion is discharged.

For this, the present disclosure uses the overflow tube 200 provided at the water tank T which stores water used for discharging excretion.

When a water level in the water tank T reaches a certain level, the overflow tube 200 allows the water to overflow to the toilet bowl body 100 so that the water does not run over the water tank T.

The overflow tube 200 is generally connected to one side of a main supply tube 300, which allows the water in the water tank T to flow to the toilet bowl body 100. Also, a stopper 310 connected to an actuating lever 330 is installed at a top of the main supply tube 300, and thus if the user presses the actuating lever 330 to flush the toilet after defecation, the stopper 310 is opened so that the water in the water tank T flows to the toilet bowl body 100 while keeping a hydraulic pressure constantly to discharge excretion to a septic tank.

In addition, if the water level is lowered, an external supply tube 340, namely a portion connected to a water pipe P, is opened so that water is supplied from the outside to fill the water tank T. If the water level reaches a certain level, a float 320 is lifted to close a supply valve (with no reference symbol) to stop supply of water. Also, the stopper 310 closes the top of the main supply tube 300 again by its weight.

The above structure and operations are substantially identical to those of an existing toilet bowl.

At this time, the main supply tube 300 is vacant at ordinary time but allows water to flow only when discharging excretion, and the overflow tube 200 is also filled with water only at overflowing. Therefore, there is no problem in inhaling or exhausting gas through these tubes at ordinary time.

The present disclosure has prepared in this consideration of the above situations, and thus in the present disclosure, for example, a valve unit 400 is mounted to a top of the overflow tube 200.

As shown in FIG. 3, the valve unit 400 includes a valve sheet 410 having a sealing material 412 capable of sealing an open top of the overflow tube 200, a floating body 420 provided at both sides of the valve sheet 410 or an outer side of a rotary body, a valve body 460 guided to allow the valve sheet 410 to move vertically, a spring 430 interposed into the valve body 460 and located at an upper portion of the valve sheet 410, a stationary plate 440 fixed to a top of the valve body 460, an exhaust port 450 configured to communicate with the overflow tube 200 through the stationary plate 440 and the valve body 460, and a makeup water feeding hole WSS configured to communicate with the overflow tube 200 through the valve sheet 410.

In addition, a flexible air suction tube 500 is installed at the exhaust port 450, and the air suction tube 500 extends into the water in the water tank T and is connects to a Venturi connector 600 of FIG. 2, installed in the water tank T.

At this time, the Venturi connector 600 includes a suction tube 610 and a discharge tube 620 respectively provided at right and left sides thereof, and a connection tube 630 protruding on an upper portion of the Venturi connector 600. Also, the air suction tube 500 is connected onto the connection tube 630, and a Venturi channel 640 is provided in the Venturi connector 600 where the connection tube 630 is formed, thereby giving a Venturi effect.

In other words, a channel at a center of a path where circulating water flows in and out is narrowed to give a difference in flow rates, and at the center portion, the channel is slightly bent toward a discharging end, thereby configuring the Venturi channel 640. The Venturi channel 640 gives a Venturi effect, and in other words, a fluid on the Venturi channel 640 is naturally sucked therein due to a pressure difference according to Bernoulli's theorem. Such a Venturi structure is well known in the art and thus is not described in detail here.

In addition, the Venturi connector 600 may be installed at any one of the circulating water suction tube 710 and the circulating water discharge tube 720, and also a suction end 610 and a discharge end 620 are provided at both ends of the Venturi connector 600 for connection and installation thereof.

Also, the circulating water suction tube 710 is connected to a sucking end of a circulating pump 700, and the circulating water discharge tube 720 is connected to a discharging end of the circulating pump 700.

In addition, as shown in FIG. 2, the circulating pump 700 may be fixed to a bottom of the water tank T.

However, the circulating pump 700 may not be fixed to a bottom of the water tank T, as long as water may circulate in the water tank T.

Moreover, the circulating water suction tube 710 and the circulating water discharge tube 720 are placed freely in the water tank T.

However, the circulating water suction tube 710 and circulating water discharge tube 720 may be suitably fixed not to float over the water surface when the circulating pump 700 is in operation.

Moreover, in the present disclosure, since the air suction tube 500 is vertically connected to an upper side of the Venturi connector 600, it is not needed to provide a check valve to prevent a back flow, which leads to a simple structure, easy fabrication, very efficient operation and effective suction and discharge.

In addition, a switch may be provided so that the circulating pump 700 may be selectively operated before defecation, during defecation and after defecation. Here, a manual switch may be used so that the circulating pump 700 is operated according to the selection of the user.

Moreover, it is also possible that the circulating pump 700 is automatically operated when a user is at a predetermined distance from the toilet bowl body 100 before and after defecation, by using a sensor such as a temperature sensor or an approach sensor.

Further, though not shown in the figures, a solenoid valve may be further mounted to the valve unit 400, so that the valve unit 400 is closed at ordinary time but is opened during or after defecation to suck and discharge bad smell and pathogenic bacteria.

In addition, by applying a combination of the sensor and the solenoid valve mentioned above, it is also possible that the actuating lever 330 is not provided but the stopper 310 is automatically opened to supply water for discharging excretion when a user stands up after defecation.

Figure 4:
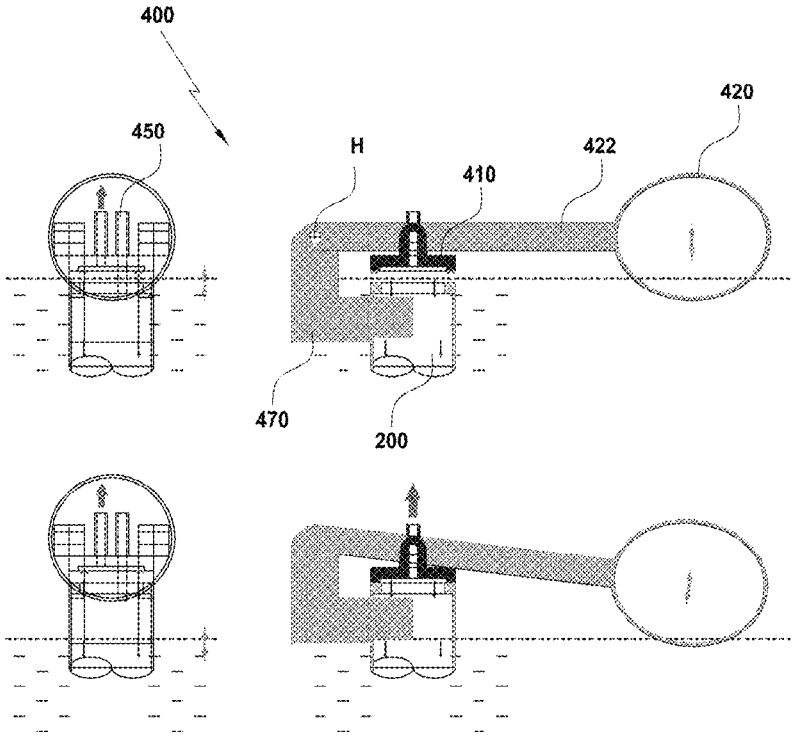
FIG. 4 is a cross-sectional view showing another example of the valve unit applied to the sanitary toilet bowl according to the first embodiment of the present disclosure.

Meanwhile, the valve unit 400 may be modified as shown in FIG. 4.

For example, in the configuration of FIG. 4, when the valve sheet 410 is opened or closed according to a water level by using the floating body 420, the floating body 420 and the valve sheet 410 may be operated using a hinge.

In other words, the valve unit 400 may be configured to operate in the same way as shown in FIG. 3 by providing a support 470 fixed to one side of the overflow tube 200 and having a 'L' shape, fixing an end of a lever 422 for fixing the floating body 420 to a top of the support 470 by a hinge H, simultaneously fixing the valve sheet 410 to a part of the lever 422 by a hinge, and providing an exhaust port 450 communicating with the overflow tube 200 through the valve sheet 410 and a makeup water feeding hole WSS communicating with the overflow tube 200 through the valve sheet 410 so that the valve sheet 410 does not interfere in a hinged portion of the lever 422.

In addition, the sucking and discharging structure applied to FIG. 3 may also be identically applied to the exhaust port 450 of the valve unit 400 configured as shown in FIG. 4.

If the sanitary toilet bowl according to the present disclosure configured as above is used, when a user seats on the toilet bowl for defecation, this is instantly detected and the circulating pump 700 is operated to give a Venturi effect.

If so, the air in the air suction tube 500 connected to the Venturi connector 600 is sucked to the Venturi connector 600, and this resultantly leads to suction of an inner air of the toilet bowl body 100 through the overflow tube 200 and the main supply tube 300.

Therefore, bad smell generated during defecation is carried to the air suction tube 500 together with air containing pathogenic bacteria, and then is repeatedly discharged and sucked in the water of the water tank T together with a circulating water so as to be dissolved and removed therein. Finally, when the user presses the actuating lever 330 to discharge the water in the toilet bowl to a septic tank after defecation, the bad smell and the pathogenic bacteria are discharged together. Therefore, bad smell and pathogenic bacteria do not propagate in the toilet but are perfectly removed cleanly, thereby giving a more pleasant toilet environment.

In other words, bad smell and pathogenic bacteria which are in a full level after initiating defecation are rapidly reduced, and when defection is finished, bad smell and pathogenic bacteria do not substantially propagate. Since this process is performed automatically, the user does not feel inconvenience.

By doing so, it is expected to enhance the health of families, prevent various skin ailments, and eliminate inconvenience caused by closing a toilet bowl cover whenever using a toilet. Thus, in the aspect of the entire nation, it is expected to enhance the health of citizens.

In addition, on occasions, after excretion is discharged, bad smell and pathogenic bacteria may be sucked and discharged once more, which may give a further pleasant toilet space.

Figure 5:
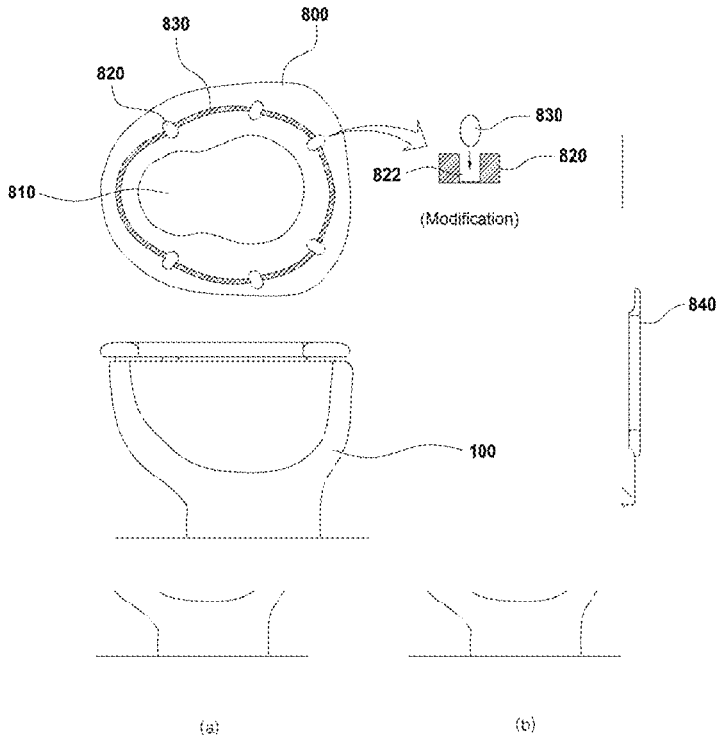
FIG. 5 is a diagram showing an essential part of a toilet bowl pedestal applied to the sanitary toilet bowl according to the first embodiment of the present disclosure.

Moreover, the sanitary toilet bowl may employ a toilet bowl pedestal as shown in FIG. 5.

The toilet bowl pedestal includes a pedestal body 800, which may have various shapes and configurations known in the art.

In addition, the pedestal body 800 has an opening 810 formed at a center thereof to have a certain shape, and the opening 810 serves as a passage through which a user may defecate.

Moreover, protrusions 820 are formed on a lower surface of the pedestal body 800 and arranged in a circumferential direction, similar to an existing technique.

These protrusions 820 support the toilet bowl body 100 in contact in a circumferential direction when the pedestal body 800 is lowered and placed on the upper surface of the toilet bowl body 100, thereby keeping a gap between the pedestal body 800 and the toilet bowl body 100.

In this structure, in the present disclosure, a sealing member 830 for sealing a space between the protrusions 820 may be further provided.

The sealing member 830 may have a band shape as depicted in the figures, and the sealing member 830 may be made of flexible material such as rubber or silicon to enhance a sealing force.

Moreover, the sealing member 830 may be detachably provided for easy cleaning, which may further enhance sanitation. In addition, when being worn out, the sealing member 830 may be easily exchanged by the user, which may reduce maintenance costs.

In this case, the detachable structure may adopt various known techniques such as fitting into a groove, adhering using a double-sided adhesive tape or the like.

In addition, as shown in an enlarged view of FIG. 5, a fixing groove 822 may be formed in the protrusion 820, and the sealing member 830 may be forcibly fit into the fixing groove 822. In this case, the sealing member 830 may have an oval shape convex in a vertical direction, which is elastically deformed to enhance a sealing force when being pressed by the user who seats thereon.

Figure 6:
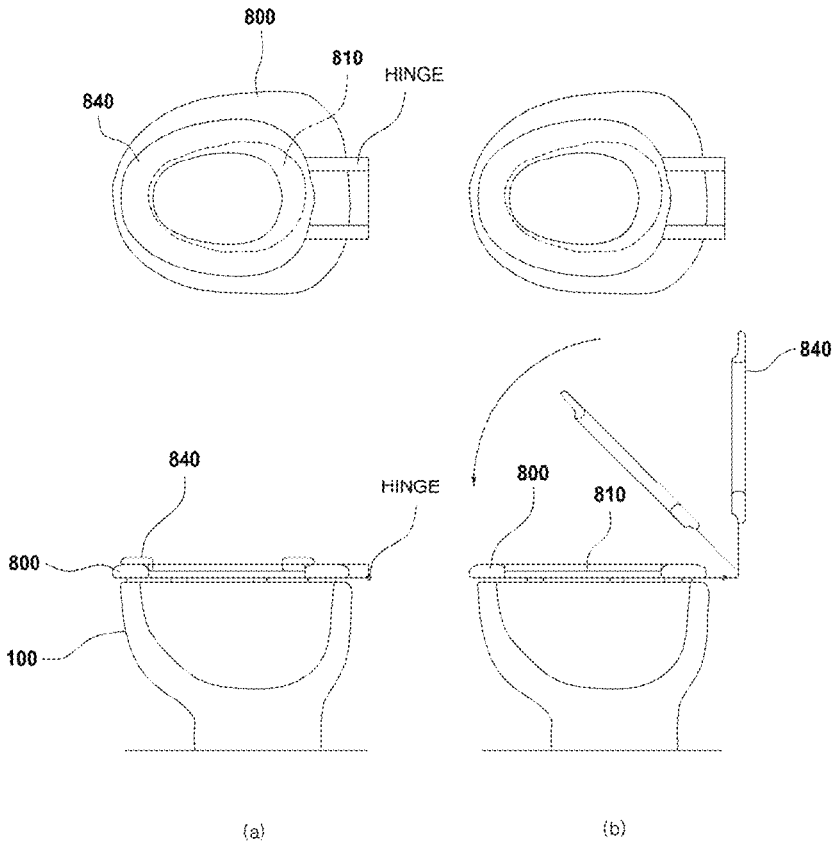
FIG. 6 is a diagram showing another example of the toilet bowl pedestal applied to the sanitary toilet bowl according to the first embodiment of the present disclosure.

Moreover, as shown in FIG. 6, when a young child seats on the toilet bowl, a space is generated in a rear area between the butt of the young child and the pedestal body 800. Therefore, if the auxiliary pedestal 840 is provided, the young child may have a good seating feeling, and also pathogenic bacteria may be sucked and removed more efficiently.

At this time, the auxiliary pedestal 840 may be detachably provided to the pedestal body 800, and the detachable structure may include a simple detachable structure such as fitting, or a pivotal detachable structure connected to the pedestal body 800 by a hinge.

By doing so, even when a young child uses the toilet bowl, pathogenic bacteria may be sucked and removed efficiently, which may greatly contribute to improvement of a sanitary environment of the toilet.

Second Embodiment

Figure 7:
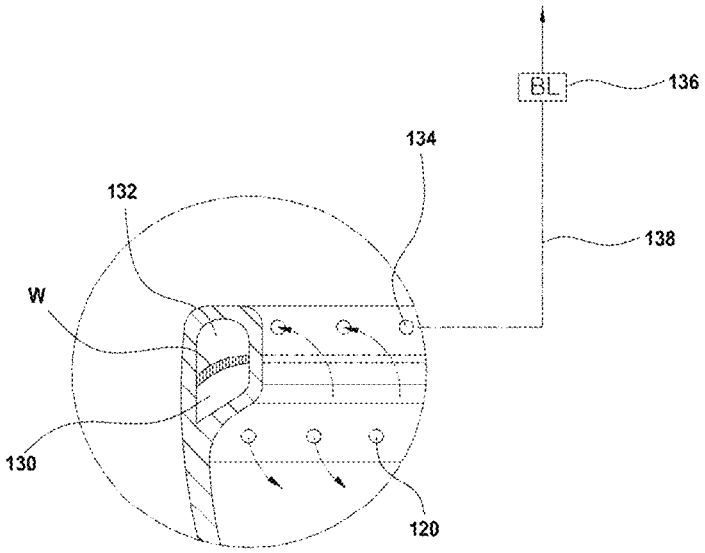
FIG. 7 is an enlarged view showing an essential part of a sanitary toilet bowl according to the second embodiment of the present disclosure.
Figure 8:
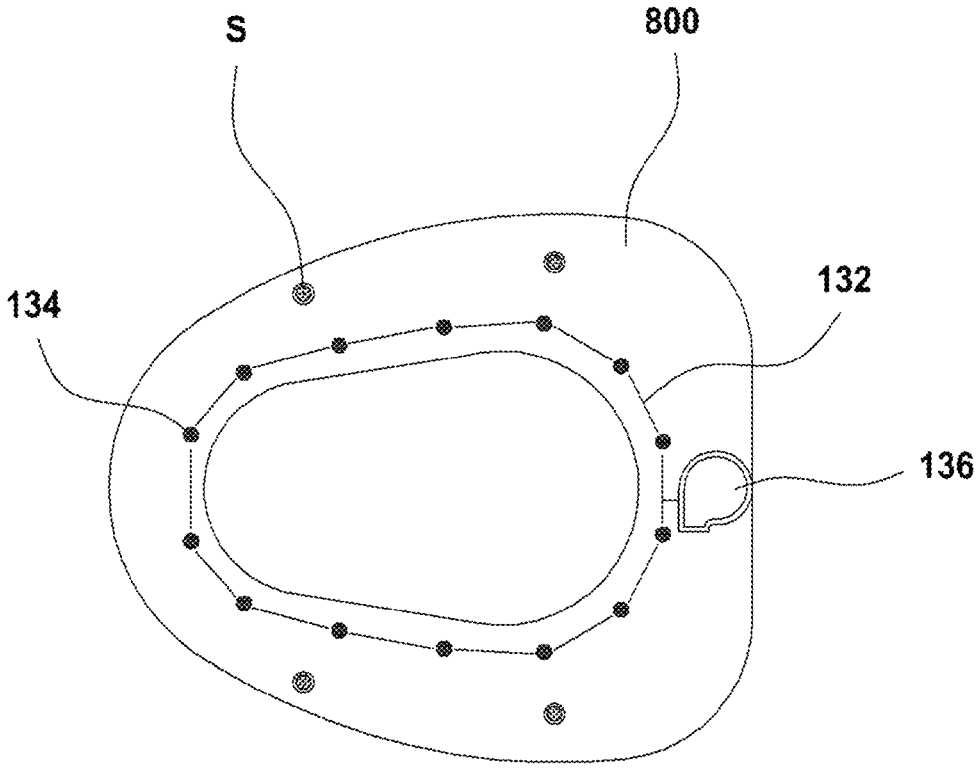
FIG. 8 is a diagram showing a toilet bowl pedestal applied to the sanitary toilet bowl according to the second embodiment of the present disclosure.
Figure 8:
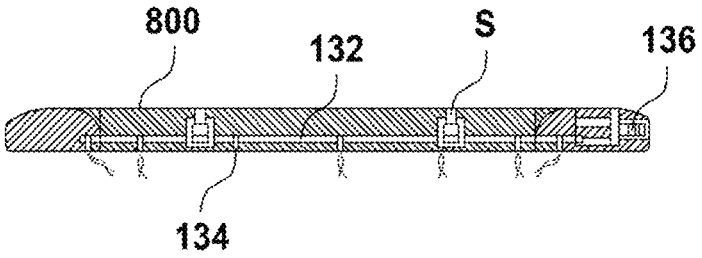

As shown in FIGS. 7 and 8, a sanitary toilet bowl according to the second embodiment of the present disclosure is modified so that an air curtain serving as a kind of shield is formed at the toilet bowl body 100 to prevent bad smell and pathogenic bacteria from propagating out of the toilet bowl body 100.

In other words, the sanitary toilet bowl according to the second embodiment of the present disclosure rapidly sucks and discharges the air in the toilet bowl body 100 during or after defecation to temporarily block the inside of the toilet bowl body 100 from a toilet, thereby giving an air curtain function. By doing so, it is possible to prevent bad smell and pathogenic bacteria from rapidly propagating in the room, and thus it is possible to give more pleasant toilet environment with less harm to a human body.

For this, as shown in FIG. 7, in the toilet bowl body 100 according to the second embodiment of the present disclosure, the supply water feeding chamber 130 is partitioned into upper and lower areas by using a partition W so that the lower area is utilized as the supply water feeding chamber 130, similar to the former embodiment, and the upper area is utilized as an air suction chamber 132.

In addition, a plurality of air suction holes 134 communicating with the air suction chamber 132 are formed along an inner circumference of the top of the toilet bowl body 100, similar to the injection holes 120.

Also, the air suction chamber 132 is connected to an air blower 136.

At this time, the air blower 136 may be included in the toilet bowl body 100, or installed out of the toilet bowl body 100 as shown in the figure. In addition, a power source of the air blower 136 may be prepared by drawing a power source of a ventilator (not shown) which is already installed at the toilet.

Moreover, the air suction chamber 132 and the air blower 136 of the toilet bowl body 100 are connected to each other by a flexible tube 138 so that the air in the air suction chamber 132 is sucked into the air blower 136. For example, in case of a toilet newly built, the flexible tube 138 may be buried in a wall and connected to a ventilation hole through the wall. Also, in case of an existing toilet, the flexible tube 138 may be fixed along a wall or ceiling and connected to a ventilation hole through a pipe.

As another example, the flexible tube 138 may be drawn into the water tank T, which stores a service water for discharging excretion, instead of a ventilation hole, and then a bubble generator (not shown) may be installed at an end of the flexible tube 138 so that a sucked air containing bad smell and pathogenic bacteria, which has been sucked during defecation, is diluted in the water tank T together with bubbling and then discharged to a septic tank together with excrement.

If bad smell and pathogenic bacteria are drawn into the water tank T and discharged as described above, bad smell and pathogenic bacteria are not directly discharged to the air, but are discharged to a septic tank together with excrement after staying in the water tank T. For this reason, the possibility that bad smell or pathogenic bacteria is introduced into the toilet is extremely low, which gives better effects in aspect of environment and harmlessness to a human body.

Moreover, a switch may be provided to selectively operate the air blower 136 before defecation, during defecation and after defecation. Here, a manual switch may be used so that the air blower 136 is operated according to the selection of the user.

However, the switch may also employ a motion sensor switch or a pressure sensor switch, without being limited to a manual switch, namely an on/off switch known in the art. In addition, a sensor employed in the switch may be installed on a wall of the upper portion of the water tank T, and an installation location of the switch may be varied according to the kind of the switch as described later.

If the switch is a motion sensor switch, the switch turns on/off a power by detecting a motion of the user to operate or stop the air blower 136. If the switch is a pressure sensor switch, the switch detects a pressure when the user seats on the toilet bowl body 100, and if the applied pressure is greater than a predetermined level, the switch automatically allows the air blower 136 to operate, but if the pressure is released, the switch allows the air blower 136 to stop operation. At this time, a pressure is detected when the user seats on the toilet bowl body 100, and this means that when the user seats on the pedestal body 800, a pressure sensor S (see FIG. 8) buried near the switch detects a pressure by the weight of the user at a portion where the pedestal body 800 contacts the top surface of the toilet bowl body 100.

In addition, a sterilizing solution may be supplied to the supply water feeding chamber 130 when the air blower 136 operates, which may give a sterilizing or pasteurizing function together.

Moreover, the air curtain employed in the sanitary toilet bowl according to the second embodiment of the present disclosure may also be implemented at the pedestal body 800 as shown in FIG. 8.

In this case, the pedestal body 800 may be provided to a dedicated toilet bowl pedestal with an air curtain suction structure, or the pedestal body 800 may be added to an existing toilet bowl pedestal which is already put in the market. However, the dedicated toilet bowl pedestal may be prepared by molding the air suction chamber 132 together with a pedestal to have an integral form as shown in FIG. 8, and a plurality of air suction holes 134 may be formed therein.

In addition, the pressure sensor S may be included in the pedestal body 800 so that the air blower 136 is operated by detecting a pressure change caused when the user seats on the pedestal body 800.

In this case, the air blower 136 may be included or buried in a lower portion of the rear side of the pedestal body 800.

Third Embodiment

Figure 9:
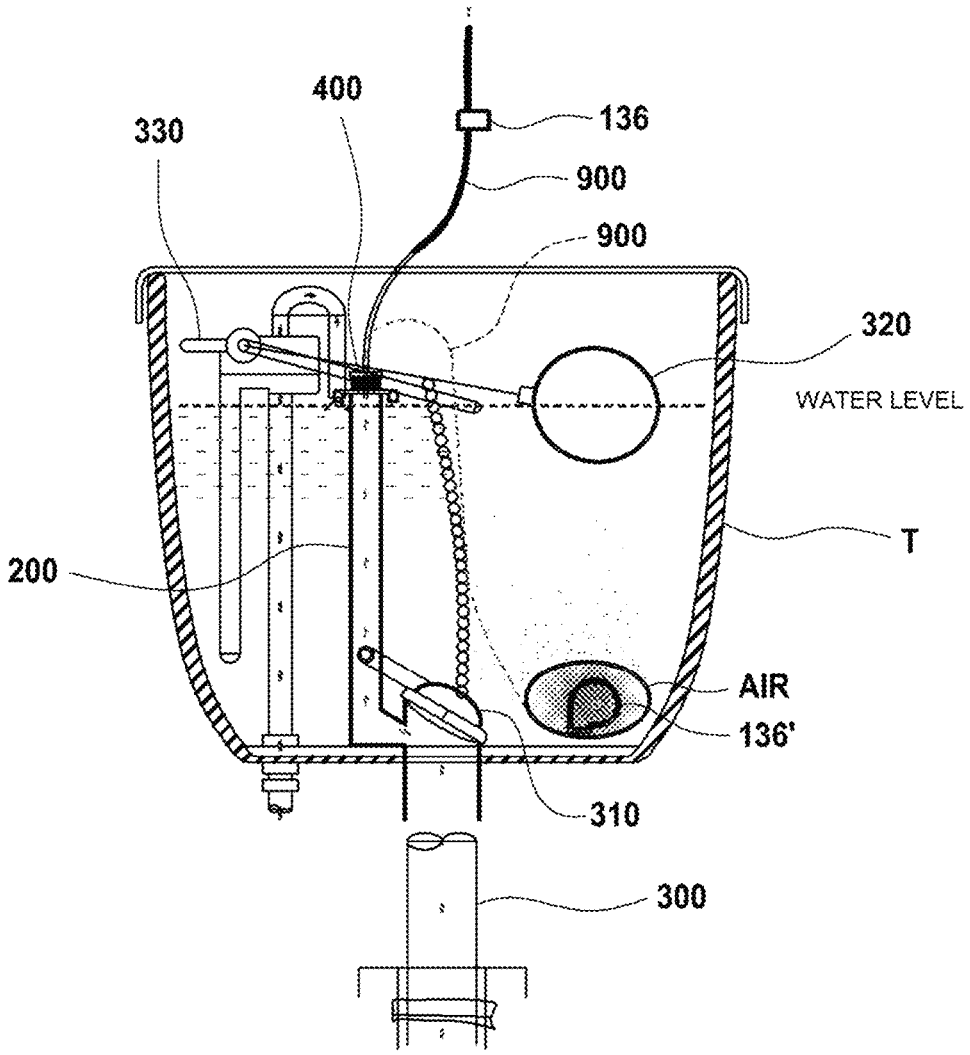
FIG. 9 is a cross-sectional view showing a sanitary toilet bowl according to the third embodiment of the present disclosure.

As shown in FIG. 9, a sanitary toilet bowl according to the third embodiment of the present disclosure is modified so that the overflow tube 200 provided at the water tank T is utilized to discharge bad smell and pathogenic bacteria.

In other words, the overflow tube 200 is generally connected to one side of the main supply tube 300, which allows water in the water tank T to flow to the toilet bowl body 100. Also, the stopper 310 connected to the float 320 is installed at the top of the main supply tube 300. Here, if the user presses lever 330 to discharge the water after defecation, the float 320 is lifted to open the stopper 310 so that the water in the water tank T flows to the toilet bowl body 100 while keeping a constant hydraulic pressure to discharge excretion to a septic tank.

In addition, if a water level is lowered, a portion connected to a water pipe P (see FIG. 2) is opened so that water is supplied from the outside to fill the water tank T. If the water level reaches a certain level, the supply of water is stopped, and the stopper 310 closes the top of the main supply tube 300 due to its weight.

At this time, the main supply tube 300 is vacant at ordinary time but allows water to flow only when discharging excretion, and the overflow tube 200 is also filled with water only at overflowing. Therefore, there is no problem in inhaling or exhausting gas through these tubes at ordinary time.

In this consideration, in the sanitary toilet bowl according to the third embodiment of the present disclosure, the valve unit 400 illustrated in FIGS. 3(*a*) and 4 may be mounted to the top of the overflow tube 200, an air exhaust pipe 900 may be connected to an exhaust port 450 of the valve unit 400 and drawn out of the water tank T, and then the air exhaust pipe 900 may be connected to an air blower 136 at the exterior and drawn out of the toilet through a ventilation hole installed at the toilet.

At this time, the air blower 136 may be included in the toilet bowl body 100, or may be installed out of the toilet bowl body 100 as depicted in the figure.

In this case, the air exhaust pipe 900 may be prepared to have a thin and flat shape so as to cause no problem when being drawn out through a gap (within a processing error range) created when a lid of the water tank T is coupled. In addition, in case of a toilet newly built, the air exhaust pipe 900 may be buried in a wall and connected to a ventilation hole. Also, in case of an existing toilet, the air exhaust pipe 900 may be fixed along a wall or ceiling and connected to a ventilation hole through a pipe.

As another example, the air exhaust pipe 900 may be drawn into the water tank T, which stores a service water for discharging excretion, instead of a ventilation hole and connected to an air blower 136' in the water, and then a bubble generator AIR may be installed at an end of the air exhaust pipe 900 so that a sucked air containing bad smell and pathogenic bacteria, which has been sucked during defecation, is diluted in the water tank T together with bubbling and then discharged to a septic tank together with excrement.

If bad smell and pathogenic bacteria are drawn into the water tank T and discharged as described above, bad smell and pathogenic bacteria are not directly discharged to the air, but are discharged to a septic tank together with excrement after staying in the water tank T. For this reason, the possibility that bad smell or pathogenic bacteria is introduced into the toilet is extremely low, which gives better effects in aspect of environment and harmlessness to a human body.

Fourth Embodiment

Figure 10:
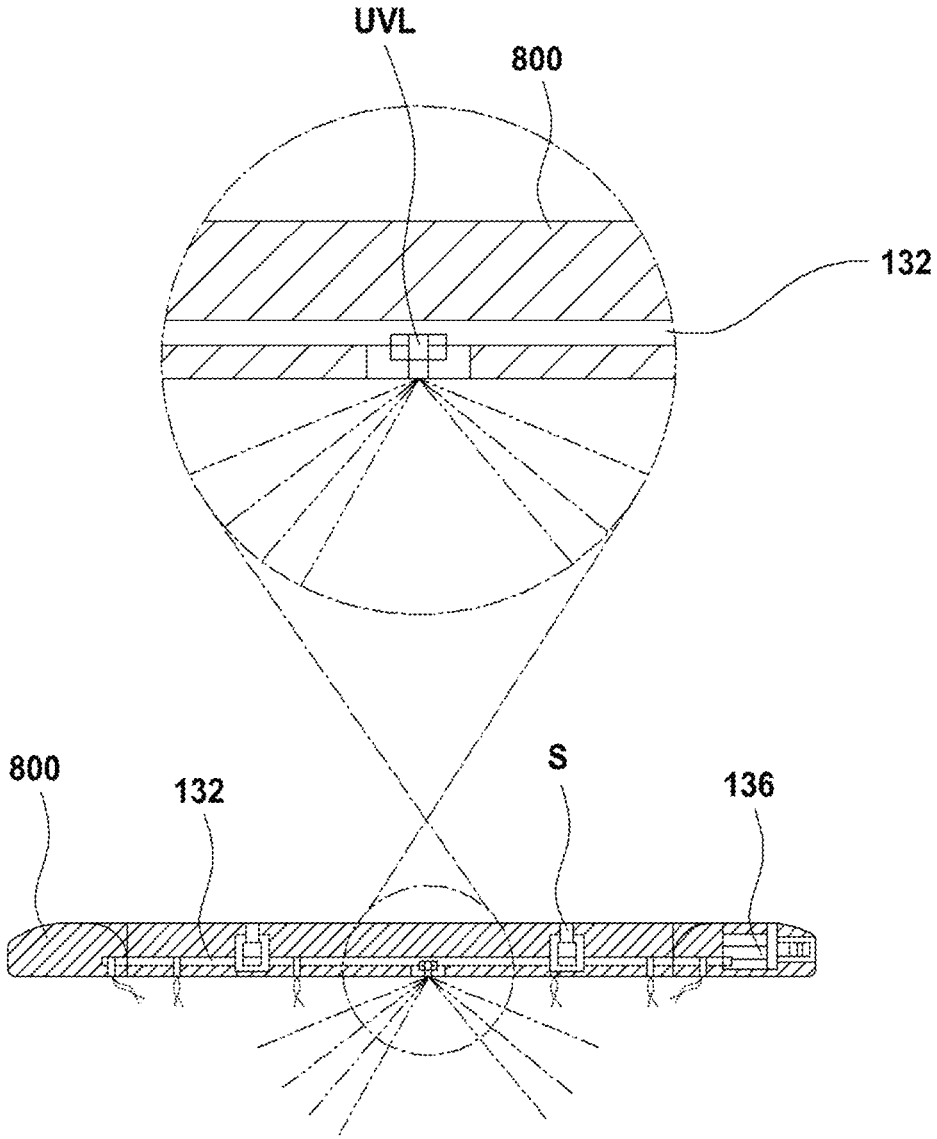
FIG. 10 is a cross-sectional view showing a toilet bowl pedestal applied to a sanitary toilet bowl according to the fourth embodiment of the present disclosure.

As shown in FIG. 10, a sanitary toilet bowl according to the fourth embodiment of the present disclosure is modified to further include at least one ultraviolet lamp UVL provided at a part of a lower surface of the toilet bowl pedestal employed in the former embodiment, namely the pedestal body 800.

At this time, the ultraviolet lamp UVL is a lamp for irradiating sterilizing rays of 185.7 nm, and the ultraviolet lamp UVL receives a power to irradiate sterilizing rays for a certain time so that a small amount of residual bad smell and pathogenic bacteria not sucked or discharged but remaining in the toilet bowl body 100 is sterilized, decomposed and removed.

For this, the ultraviolet lamp UVL may be controlled to turn on only when bad smell and pathogenic bacteria in the toilet bowl body 100 are sucked and discharged.

In other words, the ultraviolet lamp UVL may be designed to irradiate ultraviolet rays within a relatively short time in a state where a user does not seat on the toilet bowl, in consideration of harmfulness of ultraviolet rays to a human, and just operate only when a toilet bowl cover (not shown) provided above the pedestal body 800 is closed. In addition, control logic may be designed to eject water once again into the toilet bowl after irradiating ultraviolet rays. These configurations may be selectively designed depending on specifications of the toilet bowl.

Moreover, the ultraviolet lamp UVL may be installed on the air suction chamber 132 to sterilize the inside of the air suction chamber 132 as well as the inside of the toilet bowl body 100, when performing a sterilizing action.

Figure 11:
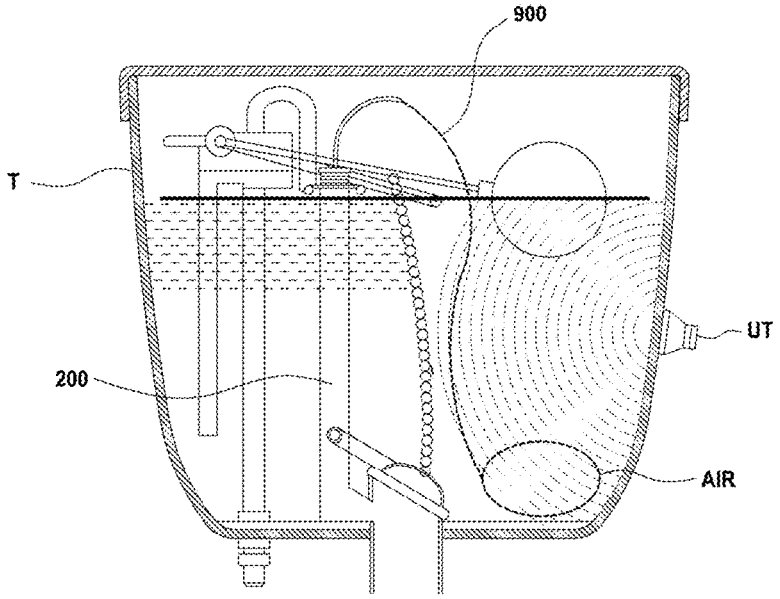
FIG. 11 is a diagram showing a water tank applied to the sanitary toilet bowl according to the fourth embodiment of the present disclosure.

In addition, if the bubble generator AIR is installed in the water tank T as shown in FIG. 11, an ultrasonic generator UT may be installed at one outer side of the water tank T, and when the bubble generator AIR operates, namely when the air blower 136 operates, the ultrasonic generator UT may operate simultaneously. In this case, bad smell and pathogenic bacteria may be dissolved more efficiently.

Figure 12:
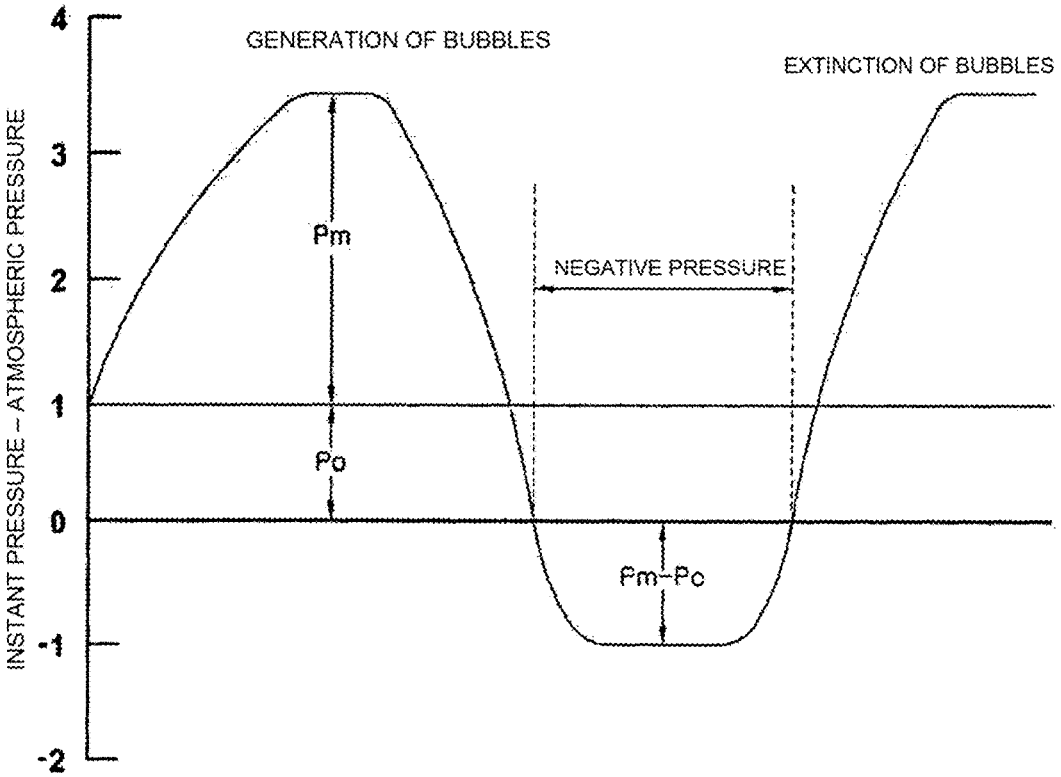
FIG. 12 is a graph showing a cavitation phenomenon caused by the generation of ultrasonic waves according to the present disclosure.

This uses a cavitation phenomenon caused by the generation of ultrasonic waves. The cavitation phenomenon means that, if a strong ultrasonic wave is irradiated into liquid, the ultrasonic wave forms a pressure wave and enhances solvency by promoting generation and extinction of bubbles while repeatedly exhibiting a compression force (positive pressure) and an expansion force (negative pressure) as shown in FIG. 12.

In other words, during a negative pressure period, bubbles are generated around fine impurities in the liquid, and these bubbles become extinct at a next compression period. Such bubbles are repeatedly generated and extinct tens of thousands of times per one second, during which diameters of the bubbles gradually increase.

If this phenomenon is shared with the bubble generator AIR, the effect increases several times. In this case, bad smell and pathogenic bacteria sucked and discharged by the toilet bowl of the present disclosure may be perfectly dissolved and removed in the water tank T, and newly generated bubbles have no bad smell and no pathogenic bacteria.

Moreover, a sucking and discharging structure may be configured to extend to an outdoor place along a toilet air exhaust pipe, instead of the water tank T, and this is just another modification.

In other words, a sanitary toilet bowl according to the fourth embodiment of the present disclosure includes an air blower 136 connected to the air suction chamber 132 and installed at a rear end of the pedestal body 800, a ultraviolet lamp UVL designed to irradiate ultraviolet rays only for a certain time after the air blower 136 stops operation, and an air exhaust pipe 900 extending from a discharge end of the air blower 136 and connected into the water tank T, wherein a bubble generator AIR disposed to be soaked in the water tank T is installed at an end of the air exhaust pipe 900.

As described above, in the present disclosure, bad smell and pathogenic bacteria are discharged to the water tank T, perfectly dissolved therein, and then discharged to a septic tank together with excretion. Therefore, the possibility that bad smell or pathogenic bacteria is introduced into the toilet is extremely low, which gives better effects in aspect of environment and harmlessness to a human body.

Further, since a sterilizing function by irradiation of ultraviolet rays is added to the toilet bowl body 100, the toilet culture becomes more sanitary and cleaner, and it is also possible to prevent skin diseases, skin allergies or the like, caused by pathogenic bacteria.

The invention claimed is:

1. A sanitary toilet bowl, which includes a toilet bowl body, a water tank for supplying water to the toilet bowl body, a main supply tube for connecting the water tank to the toilet bowl body, and an overflow tube connected to one side of the main supply tube and installed in the water tank to allow water over a predetermined level to overflow to the main supply tube, the sanitary toilet bowl comprising:

a valve unit mounted to open or close a top of the overflow tube according to a water level in the water tank;

an air suction tube installed to communicate with the overflow tube through the valve unit;

a circulating pump installed in water of the water tank and having a circulating water suction tube and a circulating water discharge tube respectively provided at both ends thereof to suck the water stored in the water tank and discharge the sucked water for circulation; and a Venturi tube installed on the circulating water suction tube or the circulating water discharge tube and connected to the air suction tube perpendicularly to generate a Venturi effect.

2. The sanitary toilet bowl of claim 1, wherein the valve unit includes:

a valve sheet having a sealing material capable of sealing an open top of the overflow tube;

a floating body provided at both sides of the valve sheet or an outer side of a rotary body;

a valve body guided to allow the valve sheet to move vertically;

a spring interposed into the valve body and located at an upper portion of the valve sheet;

a stationary plate fixed to a top of the valve body;

an exhaust port configured to communicate with the overflow tube through the stationary plate and the valve body; and a makeup water feeding hole configured to communicate with the overflow tube through the stationary plate and the valve body.

3. The sanitary toilet bowl of claim 1, wherein the valve unit includes:

a support fixed to one side of the overflow tube and having an 'L' shape;

a floating body floating in water;

a lever configured to fix the floating body and fixed to a top of the support by a hinge;

a valve sheet fixed to a part of the lever by a hinge and configured to open or close a top of the overflow tube;

an exhaust port configured to communicate with the overflow tube through the valve sheet; and a makeup water feeding hole configured to communicate with the overflow tube through the valve sheet.

4. The sanitary toilet bowl of claim 1, further comprising a pedestal body provided to the toilet bowl body so that a user seats thereon, wherein the pedestal body includes:

a pedestal body pivotally coupled to an upper surface of the toilet bowl body to guide the user to seat thereon for defecation;

a plurality of protrusions protruding on a lower surface of the pedestal body and arranged in a circumferential direction; and a sealing member fixed between the protrusions to seal a gap between the toilet bowl body and the pedestal body.

5. A sanitary toilet bowl, which includes a toilet bowl body, a water tank for supplying water to the toilet bowl body, a main supply tube for connecting the water tank to the toilet bowl body, and an overflow tube connected to one side of the main supply tube and installed in the water tank to allow water over a predetermined level to overflow to the main supply tube, the sanitary toilet bowl comprising:

a valve unit mounted to open or close a top of the overflow tube;

an air suction tube installed to communicate with the overflow tube through the valve unit;

a circulating pump installed in water of the water tank, the circulating pump includes a circulating water suction tube and a circulating water discharge tube; and a Venturi tube installed on the circulating water suction tube or the circulating water discharge tube and connected to the air suction tube perpendicularly to generate a Venturi effect.

6. The sanitary toilet bowl of claim 5, wherein the valve unit includes:

a valve sheet having a sealing material capable of sealing an open top of the overflow tube;

a floating body provided at both sides of the valve sheet or an outer side of a rotary body;

a valve body guided to allow the valve sheet to move vertically;

a spring interposed into the valve body and located at an upper portion of the valve sheet;

a stationary plate fixed to a top of the valve body;

an exhaust port configured to communicate with the overflow tube through the stationary plate and the valve body; and a makeup water feeding hole configured to communicate with the overflow tube through the stationary plate and the valve body.

7. The sanitary toilet bowl of claim 5, wherein the valve unit includes:

a support fixed to one side of the overflow tube and having an 'L' shape;

a floating body floating in water;

a lever configured to fix the floating body and fixed to a top of the support by a hinge;

a valve sheet fixed to a part of the lever by a hinge and configured to open or close a top of the overflow tube;

an exhaust port configured to communicate with the overflow tube through the valve sheet; and a makeup water feeding hole configured to communicate with the overflow tube through the valve sheet.

8. The sanitary toilet bowl of claim 5, further comprising a pedestal body provided to the toilet bowl body so that a user seats thereon, wherein the pedestal body includes:

a pedestal body pivotally coupled to an upper surface of the toilet bowl body to guide the user to seat thereon for defecation;

a plurality of protrusions protruding on a lower surface of the pedestal body and arranged in a circumferential direction; and a sealing member fixed between the protrusions to seal a gap between the toilet bowl body and the pedestal body.

* * * * *